US006866081B1

(12) United States Patent
Nordgard et al.

(10) Patent No.: US 6,866,081 B1
(45) Date of Patent: Mar. 15, 2005

(54) EXTERIOR DOOR OR WINDOW HAVING EXTRUDED COMPOSITE FRAME

(75) Inventors: Kelly D. Nordgard, Clear Lake, SD (US); Bryan P. Zacher, Brookings, SD (US); Allen E. Lee, Brookings, SD (US)

(73) Assignee: Larson Manufacturing Company of South Dakota, Inc., Brookings, SD (US)

( * ) Notice: Subject to any disclaimer, the term of this patent is extended or adjusted under 35 U.S.C. 154(b) by 0 days.

(21) Appl. No.: 10/093,096

(22) Filed: Mar. 7, 2002

Related U.S. Application Data

(60) Provisional application No. 60/274,463, filed on Mar. 9, 2001.

(51) Int. Cl.[7] ..... A47G 5/00

(52) U.S. Cl. ..... 160/371

(58) Field of Search ..... 160/371, 369, 160/377, 379; 49/503, 501; 52/656.9, 656.4, 457, 455

(56) References Cited

U.S. PATENT DOCUMENTS

| | | | | | |
|---|---|---|---|---|---|
| 2,506,978 | A | * | 5/1950 | Unterberger | 160/40 |
| 2,835,325 | A | * | 5/1958 | Gilbert et al. | 160/369 |
| 2,927,354 | A | * | 3/1960 | Lauer | 49/503 |
| 3,410,040 | A | * | 11/1968 | Biro et al. | 52/222 |
| 3,674,082 | A | * | 7/1972 | Letarte | 160/371 |
| 3,696,857 | A | * | 10/1972 | Le Tarte | 160/371 |
| 5,775,041 | A | * | 7/1998 | Tull et al. | 52/455 |
| 6,497,938 | B1 | * | 12/2002 | Hill | 52/455 X |

* cited by examiner

*Primary Examiner*—David Purol
(74) *Attorney, Agent, or Firm*—Welsh & Katz, Ltd.

(57) ABSTRACT

An exterior frame is formed of extruded, non-metallic stiles, header and base all having a common hollow cross section. The frame can be used in a door or window. The extruded material is a composite of wood fibers and resin which has been cured and has a common cross section. The extruded material can be enclosed within a polyvinyl chloride cap layer.

29 Claims, 2 Drawing Sheets

EXTERIOR DOOR OR WINDOW HAVING EXTRUDED COMPOSITE FRAME

This application is a utility application claiming the benefit of the earlier filing date of provisional application Ser. No. 60/274,463 filed Mar. 9, 2001.

FIELD OF THE INVENTION

The invention pertains to storm windows or doors. More particularly, the invention pertains to storm windows or doors which can be manufactured in a modular fashion using composite resin members of a common cross section.

BACKGROUND OF THE INVENTION

Storm doors are known which have a variety of structures and which have been manufactured of a variety of materials. One popular form of storm door is formed of members cut from extruded aluminum usually with miter joints. The members each have a common cross section and can be screwed or riveted together as is convenient. A kick plate can be provided along with glass or screen inserts.

In an alternate form of construction, the faces of a wood core door can be covered with aluminum sheet. The edges can be covered with extruded aluminum edging. This construction can provide a higher degree of security as well as thermal insulation.

Other advantages of wood core doors include a feeling of robustness and longevity due to the exterior weight present in such doors as opposed to aluminum doors. However, as noted above, such doors need to be covered with aluminum sheet and edged with aluminum extrusions for both utilitarian and aesthetic reasons.

There is a continuing need and it would be desirable to be able to manufacture frames for storm windows or doors which exhibit the positive characteristics of wood core doors without a need for commonly used aluminum sheeting and edging. Preferably such frames could be manufactured on a modular basis less expensively than known wood core doors in view of not needing the aluminum sheeting and edging. It would also be preferable if such frames could be manufactured of materials that are readily workable with standard tools of a type that could be used, for example with wood core doors.

DETAILED DESCRIPTION OF THE PREFERRED EMBODIMENTS

Figure 1:
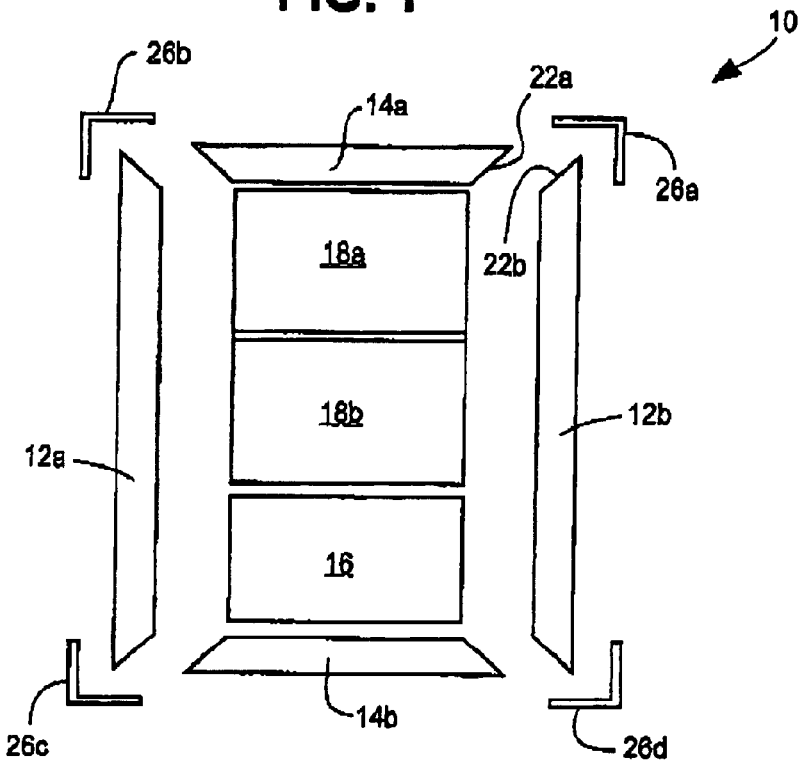
FIG. 1 is an exploded view of a modular door in accordance with the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

A door or window frame can be formed of extruded composite wood/resin material (or a wood filled plastic material) which has been cured to form a rigid, elongated, hollow extruded member. The sides and ends of the frames can be cut to form mitered joints. The joints can be reinforced with right angles, either metal or resin, which can be inserted into the internal hollow extruded frame members as the members are being assembled together to form a unitary frame. The right angle inserts can be locked to internal peripheral surfaces of each respective frame member by an interference fit alone or in combination with adhesive. The composite material can be extruded with features usable to lock glass or screen inserts to the respective frame. The extrusion can be capped with a plastic layer. Polyvinyl chloride can be used as can other plastics.

FIG. 1 illustrates an exploded view of a modular storm door or exterior door 10 in accordance with the invention. The door 10 includes stiles 12*a,b* which form the sides of the door. Stiles 12*a* and 12*b* can be joined by a header 14*a* and a foot or bottom panel 14*b*.

The door 10 can include a kick plate 16 as well as glass and/or screen inserts, such as inserts 18*a*, 18*b*.

When assembled, members 12*a,b* and 14*a,b* contact one another at 45° angle surfaces, such as surfaces 22*a*, 22*b* forming miter joints. The miter joints can be reinforced and stabilized with metal or resin right angles 26*a,b,c*, and d. Other types of joints can be used without departing from the spirit and scope of the present invention.

Figure 3:
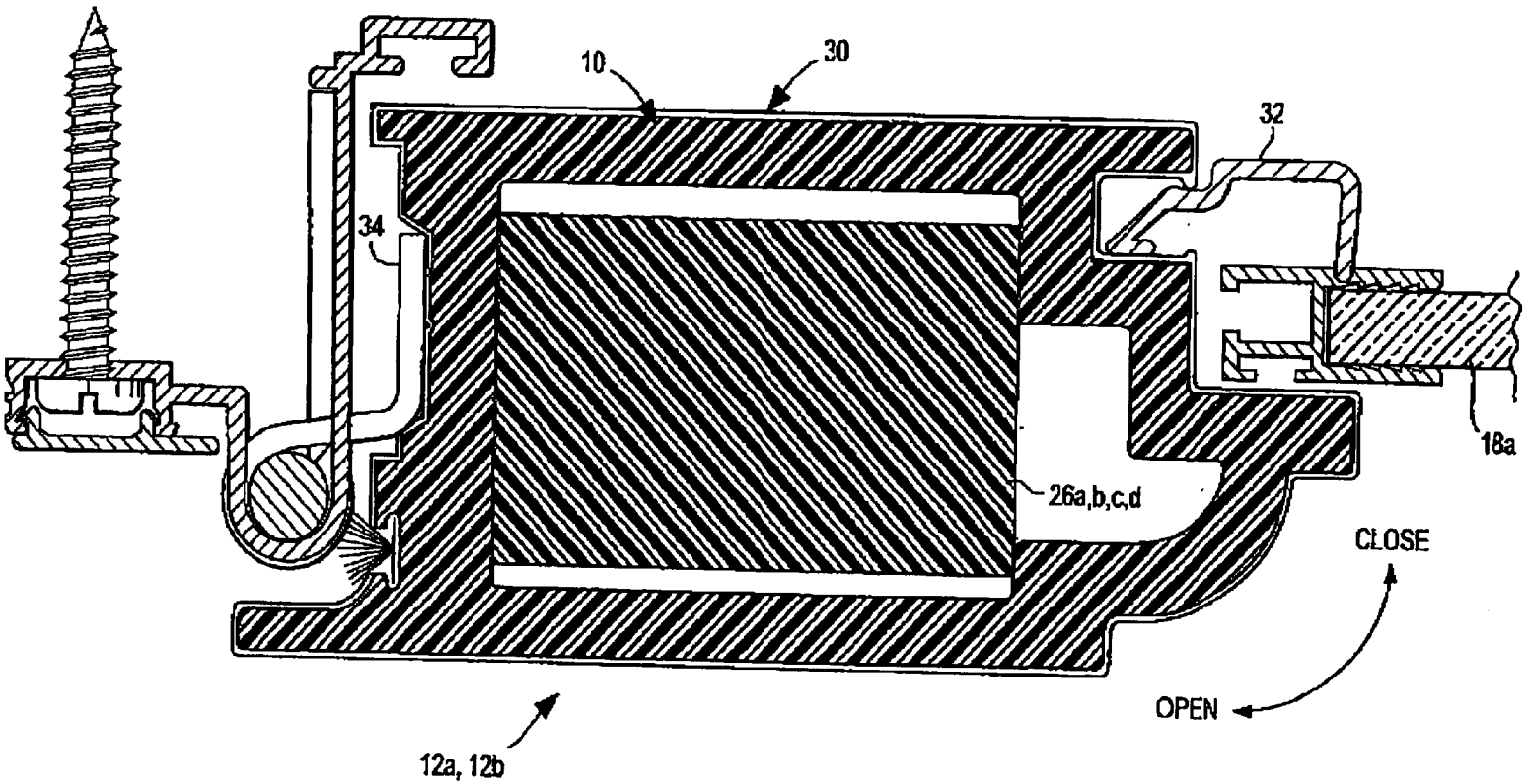
FIG. 3 is a view in section of a portion of the door of FIG. 2.

Each of the members 12*a,b*, 14*a,b* which form the frame of door 10 can be formed of an extruded composite material of wood fibers and plastic resin having a common cross section, best illustrated in FIG. 3. The extrusions can be optionally enclosed or covered with a cap 30 formed of plastic, for example, polyvinyl chloride (PVC). Other co-extrudable plastics could be used without departing from the spirit and scope of the invention.

Each of the members of the frame 12*a,b* and 14*a,b* can be cut to length to form the stiles 12*a,b* as well as the top and bottom 14*a,b* of the door 10 from a common extrusion. With or without the PVC cap 30, the extrusion exhibits a smooth continuous finished periphery. Hence, none of the edges need to be covered with either aluminum sheet or aluminum extrusion as is the case with many wood core doors.

The composite wood fiber/resin material is resistant to moisture or weathering. It is also machinable, can bc cut, threaded or screwed into using standard woodworking tools. Materials with acceptable characteristics and usable for doors or windows are commercially available and would be known to those of skill in the art. These include material marketed by Advance Environmental Recycling Technologies, Inc., TREX Inc. and Strandex Corporation.

The right angles 26*a,b,c* and *d* can be attached to the various members of the frame 12*a,b* 14*a,b* using screws or any other convenient form of fastener.

Figure 2:
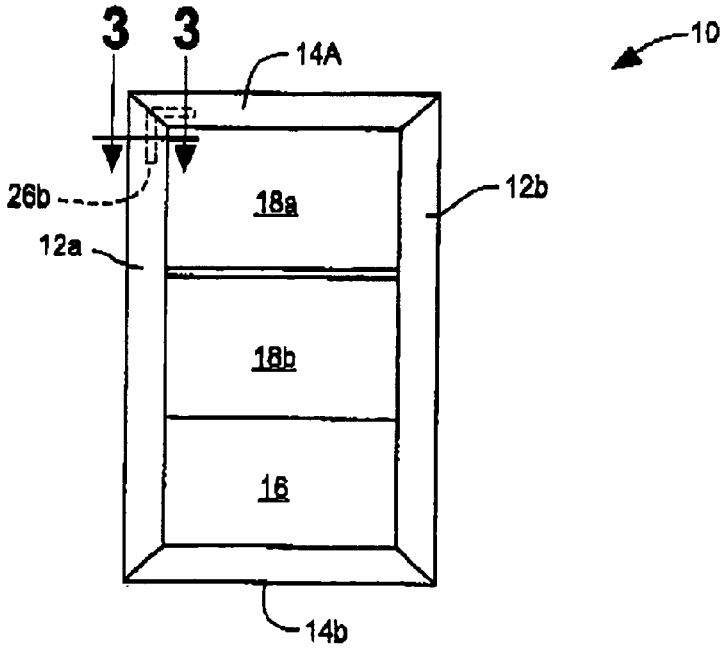
FIG. 2 is a front elevational view of the door of FIG. 1.

When assembled, the door 10, best seen in FIG. 2, presents a finished exterior appearance which also extends to the edges of the door without any need for additional processing.

The movable glass or screen inserts such as 18*a,b* can be locked in place in door 10 with one or more flexible plastic retaining members such as 32. Hinges, such as hinges 34, can be attached to one of the stiles, such as 12*a,b*, also using conventional fasteners or screws. The door 10 can be hung from a variety of metallic or non-metallic frames.

The subject extrusions can be either solid or hollow. If solid, they can incorporate exterior slots or grooves into which the right angles 26*a,b,c* and *d* can be slid and then attached to the respective members 12*a,b* and 14*a,b*.

Alternately, the material can be extruded with a void therein such that it is hollow and, as illustrated as in FIG. 3, the insert, such as 26*a*, for a pair of frame members such as 14*a*, 12*b*, can be slidably received into the hollow members at surfaces 22*a*, 22*b* with an interference fit, with or without adhesive, so as to lock the members 12*a,b* and 14*a,b* rigidly together forming a unitary door frame.

Those of skill will understand that the above-described systems and extrusions can be used to make in a substantially similar fashion four-sided window frames.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A non-metallic frame comprising first and second spaced apart stiles joined by a header and a base thereby forming a rectangular frame having four members wherein each of the members of the frame is formed of a composite extruded material of wood fibers and resin having a common cross section, and, wherein the members of the frame are joined by reinforcements, the reinforcements comprise a plurality of preassembled, right angle elements the preassembled elements are then coupled to and join respective adjacent members together.

2. A frame as in claim 1 which defines an open interior region which is filled at least in part with a glass insert.

3. A frame as in claim 1 wherein the composite material is extruded with a plastic cap layer.

4. A structure for closing an opening comprising:

a frame formed of elongated members and defining a first bounded region wherein the members of the frame are formed of extruded, composite, material capped with co-extruded plastic with each member of the frame having a common cross section and bounding an internal region and including a plurality of angle elements where each angle element engages respective internal portions of a pair of members of the frame whereupon the members are locked together to form a unitary frame.

5. A structure as in claim 4 wherein the angle elements each define a ninety degree angle and at least one of the angle elements is preassembled.

6. A structure as in claim 5 wherein the members of the frame each have first and second spaced apart ends wherein each end terminates in a selected surface.

7. A structure as in claim 6 wherein the selected surfaces are oriented at an acute angle to an axial centerline of the respective member.

8. A structure as in claim 7 wherein the first bounded region is filled at least in part with an insert which includes at least one of glass or screen.

9. A structure as in claim 8 wherein the first bounded region includes both glass and screen.

10. A structure as in claim 5 wherein the frame comprises an exterior door and includes at least one hinge.

11. A structure as in claim 5 wherein the frame comprises one of an exterior door and an exterior window.

12. A structure as in claim 5 wherein the angle elements are located within a pair of frame elements.

13. A structure as in claim 4 wherein the internal region extends axially along the interior of the cross section thereby forming a hollow extruded member.

14. A structure for closing an opening comprising:

a frame having a plurality of elongated, extruded frame elements formed of wood and resin material and covered, at least in part, with a co-extruded plastic layer wherein the frame elements exhibit a common cross section and wherein the frame bounds an interior region; and an insert of at least one of glass and screen, attachable to the frame and filling, at least in part, the interior region.

15. A structure for closing an opening comprising:

a frame having a plurality of elongated, extruded frame elements formed of wood and resin material and covered, at least in part, with a plastic layer wherein the frame elements exhibit a common cross section and wherein the frame bounds an interior region; and an insert of at least one of glass and screen, attachable to the frame and filling, at least in part, the interior region; and which includes a plurality of preassembled angles wherein each member of the plurality lockingly engages first and second frame elements at respective joints thereby forming an interconnected frame with a plurality of reinforced joints.

16. A structure for closing an opening comprising:

a frame having a plurality of elongated extruded frame elements formed of wood and resin material and covered, at least in part, with a plastic layer where the frame elements exhibit a common cross section and where the frame bounds an interior region;

an insert of at least one of glass and screen, attachable to the frame and filling, at least in part, the interior region; and a plurality of angles wherein each member of the plurality lockingly engages first and second frame elements at respective joints thereby forming an interconnected frame with a plurality of reinforced joints and wherein the plastic layer is extruded at substantially the same time as is the wood and resin material.

17. A structure as in claim 15 wherein the angles comprise separate right angle members formed of one of metal or plastic.

18. A structure as in claim 16 wherein the angles are preassembled and slidably engage the respective first and second frame elements.

19. A structure as in claim 18 wherein the frame elements each have first and second ends and define an internal void, at least in the vicinity of the respective ends wherein the angles slide into respective voids thereby internally attaching to the respective frame elements.

20. A structure as in claim 19 wherein the angles produce a ninety degree orientation between frame elements.

21. A structure as in claim 19 wherein the internal voids extend axially through respective frame members thereby forming hollow frame members.

22. A structure as in claim 20 wherein the plastic layer comprises a vinyl.

23. A structure as in claim 22 wherein the frame comprises four locked together frame elements configured in a rectangle thereby forming one of a door frame or a window frame.

24. A structure for closing an opening comprising:

a plurality of multi-layer, extruded, hollow, frame elements, one layer comprises a fiber resin composite, a second layer comprises an outer, co-extruded plastic cap;

a plurality of right angle reinforcement elements for joining adjacent frame elements, each of the reinforcement elements is received in a pair of adjacent hollow frame elements thereby locking the members of the plurality together to form a rigid frame.

25. A structure for closing an opening comprising:

a plurality of extruded hollow frame elements, formed of a fiber/resin composite;

a plurality of preassembled right angle reinforcement elements for joining adjacent frame elements each of the preassembled reinforcement elements is received in a pair of adjacent hollow frame elements thereby locking the members of the plurality together to form a rigid frame.

26. A structure for closing an opening comprising:

a frame having a plurality of elongated, extruded, hollow frame elements formed of wood and resin material and covered, at least in part, with a plastic layer where the frame elements exhibit a common cross section and where the frame bounds an interior region; and an insert of at least one of glass and screen, attachable to the frame and filling, at least in part, the interior region; and a plurality of preassembled angles where each member of the plurality engages an internal surface of each of first and second hollow frame elements at respective joints thereby forming an interconnected frame with a plurality of reinforced joints.

27. A structure for closing an opening comprising:

a plurality of extruded frame elements formed of a fiber/resin composite, each of the frame elements defines at least one axially extending internal void; and a plurality of preassembled angles, each of the angles is slidably receivable in respective portions of the voids formed in adjacent frame elements.

28. A structure as in claim 27 where the preassembled angles are separate from the extruded elements and engage respective adjacent frame elements with an interference fit.

29. A structure as in claim 27 where a plastic cap is extruded over the frame elements prior to sliding the angles thereinto.

* * * * *